US010174939B2

(12) United States Patent
Coyle et al.

(10) Patent No.: US 10,174,939 B2
(45) Date of Patent: Jan. 8, 2019

(54) SOLID FUEL NOZZLE TIPS

(71) Applicant: Babcock Power Services, Inc., Worcester, MA (US)

(72) Inventors: Michael Coyle, Simpsonville, SC (US); Dale Utterback, Greer, SC (US); Mike Boris, Moore, SC (US)

(73) Assignee: Babcock Power Services, Inc., Marlborough, MA (US)

( * ) Notice: Subject to any disclaimer, the term of this patent is extended or adjusted under 35 U.S.C. 154(b) by 429 days.

(21) Appl. No.: 14/971,614

(22) Filed: Dec. 16, 2015

(65) Prior Publication Data

US 2016/0169507 A1 Jun. 16, 2016

Related U.S. Application Data

(60) Provisional application No. 62/092,738, filed on Dec. 16, 2014.

(51) Int. Cl.
*F23D 1/00* (2006.01)

(52) U.S. Cl.
CPC ..... *F23D 1/00* (2013.01); *F23D 2201/10* (2013.01)

(58) Field of Classification Search
CPC .. B05B 1/02; B05B 1/04; B05B 1/044; B05B 1/26; B05B 1/262; B05B 3/022; B05B 3/025; F23D 2201/10; F23D 2201/101
USPC ..... 110/260, 261, 262, 263, 264, 265
See application file for complete search history.

(56) References Cited

U.S. PATENT DOCUMENTS

| | | | | |
|---|---|---|---|---|
| 2,343,572 A | | 3/1944 | Oberhuber | |
| 3,823,875 A | * | 7/1974 | Bauer | F23D 1/00 239/419.5 |
| 4,356,975 A | * | 11/1982 | Chadshay | F23D 1/00 239/419.5 |
| 6,003,793 A | * | 12/1999 | Mann | F23D 1/00 110/264 |
| 6,089,171 A | * | 7/2000 | Fong | F23C 5/06 110/104 B |
| 6,095,733 A | | 8/2000 | Busby et al. | |
| 6,145,449 A | * | 11/2000 | Kaneko | F23C 5/06 110/261 |

(Continued)

FOREIGN PATENT DOCUMENTS

KR 2012-0001183 A 1/2012

OTHER PUBLICATIONS

PCT International Search Report and Written Opinion issued on corresponding PCT International Patent Application No. PCT/US2015/066151, 12 pages.

*Primary Examiner* — David J Laux
(74) *Attorney, Agent, or Firm* — Locke Lord LLP; Alicia J. Carroll

(57) ABSTRACT

A solid fuel nozzle tip for issuing a flow of mixed solid fuel and air to a boiler includes a tip body having an inlet and an outlet defining a longitudinal axis therebetween. The tip body includes a slot on an inlet side of the tip body extending in a direction parallel to the longitudinal axis. The slot includes an opening facing the inlet side of the tip body and a recess formed at an angle with respect to the longitudinal axis to at least partially retain a pivot pin. A solid fuel nozzle assembly for issuing a flow of mixed solid fuel and air to a boiler includes a solid fuel nozzle tip with a tip body, as described above, and a locking plate operatively connected to the tip body to assist in retaining a pivot pin within the slot of the tip body.

32 Claims, 9 Drawing Sheets

(56) References Cited

U.S. PATENT DOCUMENTS

| | | | | |
|---|---|---|---|---|
| 6,145,764 | A * | 11/2000 | Gonzalez | F23D 1/00 110/261 |
| 6,260,491 | B1 * | 7/2001 | Grusha | F23D 1/00 110/261 |
| 8,267,020 | B2 * | 9/2012 | Mann | F23C 5/02 110/104 B |
| 8,561,553 | B2 | 10/2013 | Morse et al. | |
| 9,151,493 | B2 * | 10/2015 | Adam | F23D 1/00 |
| 2005/0235888 | A1 | 10/2005 | Mann et al. | |
| 2011/0114763 | A1 * | 5/2011 | Briggs, Jr. | F23D 1/00 239/587.6 |
| 2011/0117507 | A1 * | 5/2011 | Briggs, Jr. | F23C 5/06 431/189 |
| 2011/0146545 | A1 | 6/2011 | Morse et al. | |
| 2012/0193883 | A1 | 8/2012 | Tsai | |

* cited by examiner

SOLID FUEL NOZZLE TIPS

CROSS-REFERENCE TO RELATED APPLICATIONS

This application claims the benefit of priority to U.S. Provisional Patent Application No. 62/092,738 filed Dec. 16, 2014, which is incorporated by reference herein in its entirety.

BACKGROUND OF THE INVENTION

1. Field of the Invention

The present invention relates to solid fuel nozzles, and more particularly to solid fuel nozzle tips for tangentially fired boilers.

2. Description of Related Art

A variety of systems and devices are known for delivering solid fuel for combustion in a boiler. Many such devices are directed to coal nozzles for delivering solid coal particles to coal fired boilers or furnaces, for example. Coal powered plants require an efficient means of supplying coal as fuel to produce heat power. Coal nozzles can include coal tips. Conventional coal tips require removal of the complete coal nozzle assembly from the boiler in order to replace the coal tip.

Such conventional methods and systems have generally been considered satisfactory for their intended purpose. However, there is still a need in the art for improved coal tips that allow for improved ease of manufacture and assembly. The present invention provides a solution for these problems.

SUMMARY OF THE INVENTION

A solid fuel nozzle tip for issuing a flow of mixed solid fuel and air to a boiler includes a tip body having an inlet and an outlet defining a longitudinal axis therebetween. The tip body includes a slot on an inlet side of the tip body extending in a direction parallel to the longitudinal axis. The slot includes an opening facing the inlet side of the tip body and a recess formed at an angle with respect to the longitudinal axis to at least partially retain a pivot pin.

The tip body can include an inner shell and an outer shell. The outer shell can be radially outward from the inner shell with respect to the longitudinal axis. The slot can be defined on the inner shell. The outer shell can include a tab radially outward from the slot with respect to the longitudinal axis. The tab can extend from an end of the outer shell over a portion of the inner shell to form a retaining aperture therebetween.

In accordance with another aspect, a solid fuel nozzle assembly for issuing a flow of mixed solid fuel and air to a boiler includes a solid fuel nozzle tip with a tip body, as described above, and a locking plate operatively connected to the tip body to assist in retaining a pivot pin within the slot of the tip body.

In accordance with some embodiments, the locking plate is nested within the retaining aperture and is retained by the tab. The locking plate can define a plate axis. The locking plate can include an elongated plate opening extending along the plate axis. The locking plate can include a pair of opposing projections extending at an angle with respect to the plate axis away from the elongated plate opening. Each opposing projection can include an edge that abuts a surface of the tip body that faces the inlet side of the tip body. At least a portion of the elongated plate opening can be aligned with the slot of the tip body so that a pivot pin is able to pass through the locking plate and the tip body. A first portion of the elongated plate opening can be wider than a second portion of the elongated plate opening.

In accordance with some embodiments, the solid fuel nozzle assembly includes a nozzle body operatively connected to the inlet of the tip body for introducing a flow of mixed solid fuel and air to the tip body. It is contemplated that the solid fuel nozzle assembly can include a pivot pin defining a pivot axis. The pivot pin can be welded to the nozzle body and inserted through the recess of the slot of the tip body and an elongated plate opening of the locking plate to facilitate rotation of the tip body and the locking plate about the pivot pin. The solid fuel nozzle assembly can include a seal plate operatively connected to the nozzle body, between the nozzle body and the tip body.

In accordance with another aspect, a method of retrofitting a solid fuel nozzle includes positioning a tip body over a nozzle body. The nozzle body includes a pivot pin extending therefrom. The tip body is similar to the tip body described above. The method includes sliding the tip body over the pivot pin. The pivot pin engages with the slot of the tip body, slides along the slot, and engages with the recess of the slot.

The method can include removing a seal plate from the nozzle body, cutting notches into the seal plate, and repositioning the seal plate over the nozzle body. The method can include inserting the pivot pin from an interior of the nozzle body through an aperture in the nozzle body and welding the pivot pin to the nozzle body. The method can include positioning a reach rod within the tip body to align a hole in the reach rod with a link pin hole in the tip body. It is contemplated that the method can include inserting a link pin from an interior of the tip body through the link pin hole in the tip body and the hole in the reach rod. The method can include securing the link pin within the link pin hole of the tip body and the hole of the reach rod with a bow-tie cotter pin. The method can include engaging a first portion of an elongated plate opening of a locking plate with a portion of the pivot pin that protrudes from an exterior side of the tip body. The method can include pulling the locking plate toward the outlet of the tip body along the longitudinal axis to engage the pivot pin with a second portion of the elongated plate opening of the locking plate and to nest the locking plate under a tab defined in the exterior side of the tip body to secure the tip body, the locking plate and the pivot pin together.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
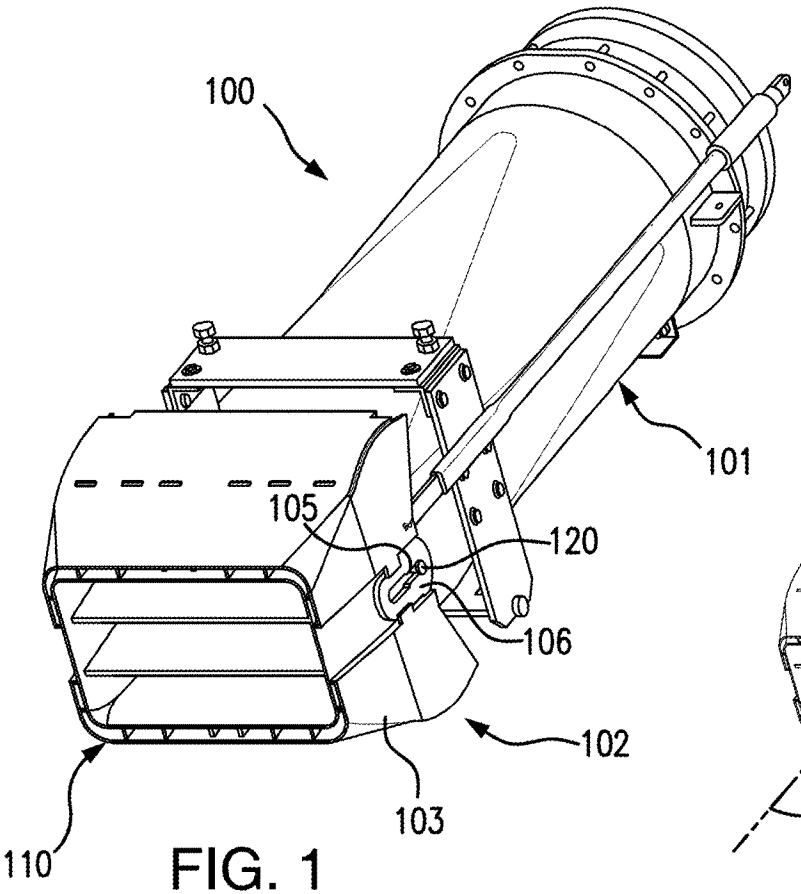
FIG. 1 is a perspective view of an exemplary embodiment of a solid fuel nozzle assembly constructed in accordance with embodiments of the present invention, showing the solid fuel nozzle tip assembled onto the solid fuel nozzle.

Reference will now be made to the drawings wherein like reference numerals identify similar structural features or aspects of the subject invention. For purposes of explanation and illustration, and not limitation, a partial view of an exemplary embodiment of a solid fuel nozzle assembly in accordance with the invention is shown in FIG. 1 and is designated generally by reference character 100. Other embodiments of solid fuel nozzle assemblies in accordance with the invention, or aspects thereof, are provided in FIGS. 2-12, as will be described.

Embodiments of the disclosure include solid fuel nozzle tips and solid fuel nozzles and methods of attaching the nozzle tips to the solid fuel nozzle to form a solid fuel nozzle assembly. For example, in accordance with certain embodiments, the nozzle tips are able to be installed and removed from within the boiler on the furnace side. By removing the nozzle tips from within the boiler, the need to remove the complete solid fuel nozzle assembly is eliminated, saving time and effort and reducing costs.

Figure 2:
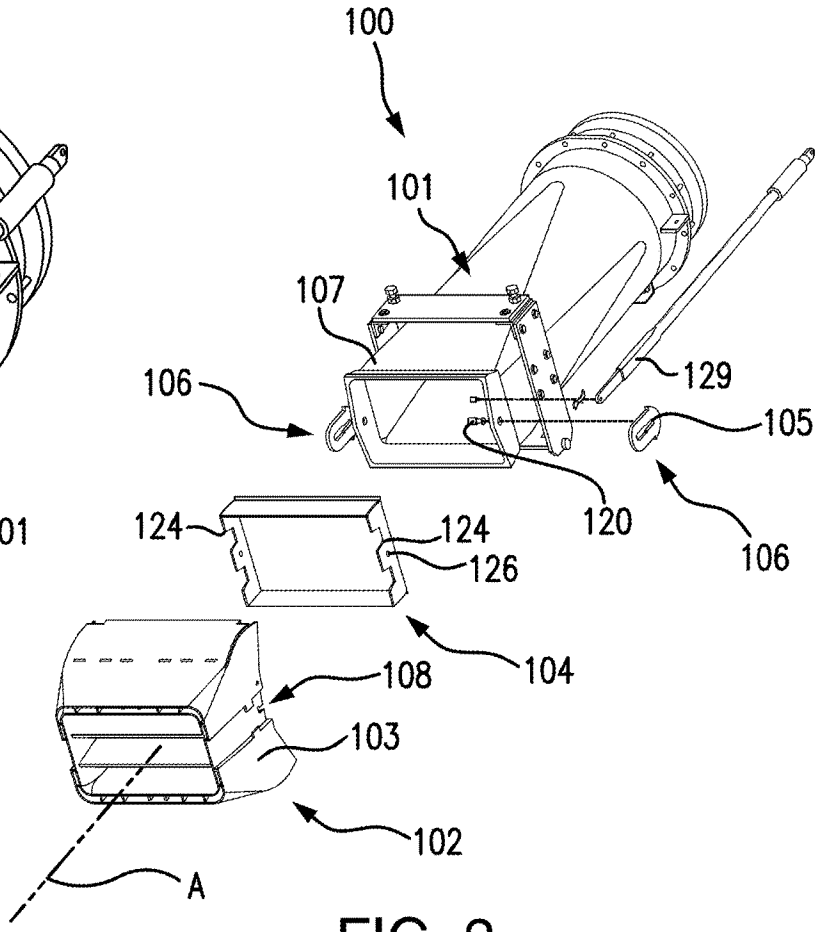
FIG. 2 is an exploded perspective view of the solid fuel nozzle assembly of FIG. 1, showing a seal plate between the solid fuel nozzle tip and the solid fuel nozzle.

A nozzle assembly 100 for issuing a flow of mixed solid fuel and air to a boiler is shown in FIGS. 1 and 2. Nozzle assembly 100 includes a solid fuel nozzle 101 and a solid fuel nozzle tip 102. Nozzle tip 102 has a tip body 103 having an inlet 108 and an outlet 110 defining a longitudinal axis A therebetween. Solid fuel nozzle 101 includes a nozzle body 107 operatively connected to inlet 108 of tip body 103 for introducing a flow of mixed solid fuel and air to tip body 103. Nozzle assembly 100 includes a pivot pin 120 and a locking plate 106 having an elongated plate opening 105. Locking plate 106 assists in retaining a pivot pin 120 within a slot 112 of tip body 103, described in more detail below. Nozzle assembly 100 includes a seal plate 104 operatively connected between nozzle body 107 and tip body 103.

Figure 3B:
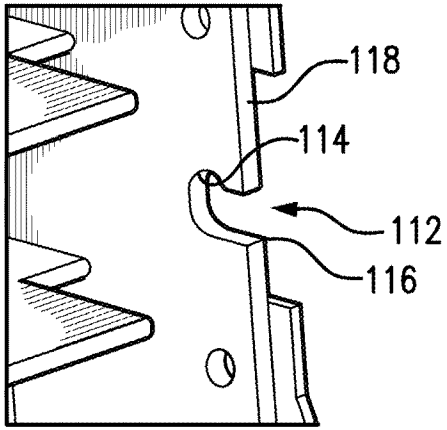
FIG. 3B is a perspective view of a portion of the nozzle tip of FIG. 3A, showing the recessed portion of slot.
Figure 3A:
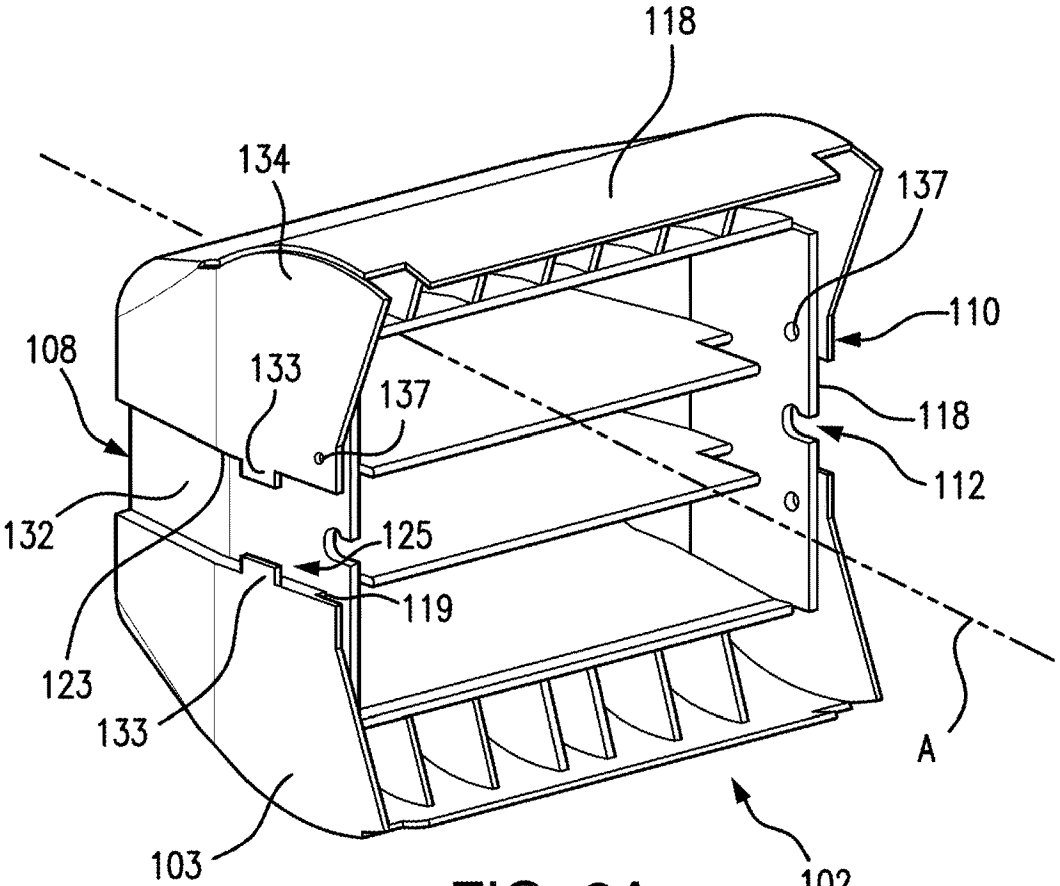
FIG. 3A is a perspective view of the nozzle tip of FIG. 1 from the inlet side of the nozzle tip, showing the slot of the nozzle tip.

As shown in FIGS. 3A and 3B, tip body 103 includes a pair of slots 112 on each side of an inlet side 118 of tip body 103. Each slot 112 extends in a direction parallel to longitudinal axis A. Each slot 112 includes a respective opening 116 facing an inlet side 118 of tip body 103. Each slot 112 includes a respective recess 114 formed at an angle with respect to longitudinal axis A and opening 116 of each respective slot 112 to at least partially retain its respective pivot pin 120, described below. Tip body 103 includes an inner shell 132 and an outer shell 134. Outer shell 134 is radially outward from inner shell 132 with respect to longitudinal axis A. Slots 112 are defined on inner shell 132. Outer shell 134 includes a pair of tabs 133 on each side of tip body 103 radially outward from respective slots 112 with respect to longitudinal axis A. Each tab in a respective pair of tabs 133 extends from a respective end 123 of outer shell 134 over a portion of inner shell 132 to form a retaining aperture 125. Inner and outer shells 132 and 134, respectively, each include aligned link pin holes 137 to receive a link pin, described in more detail below.

Figure 4:
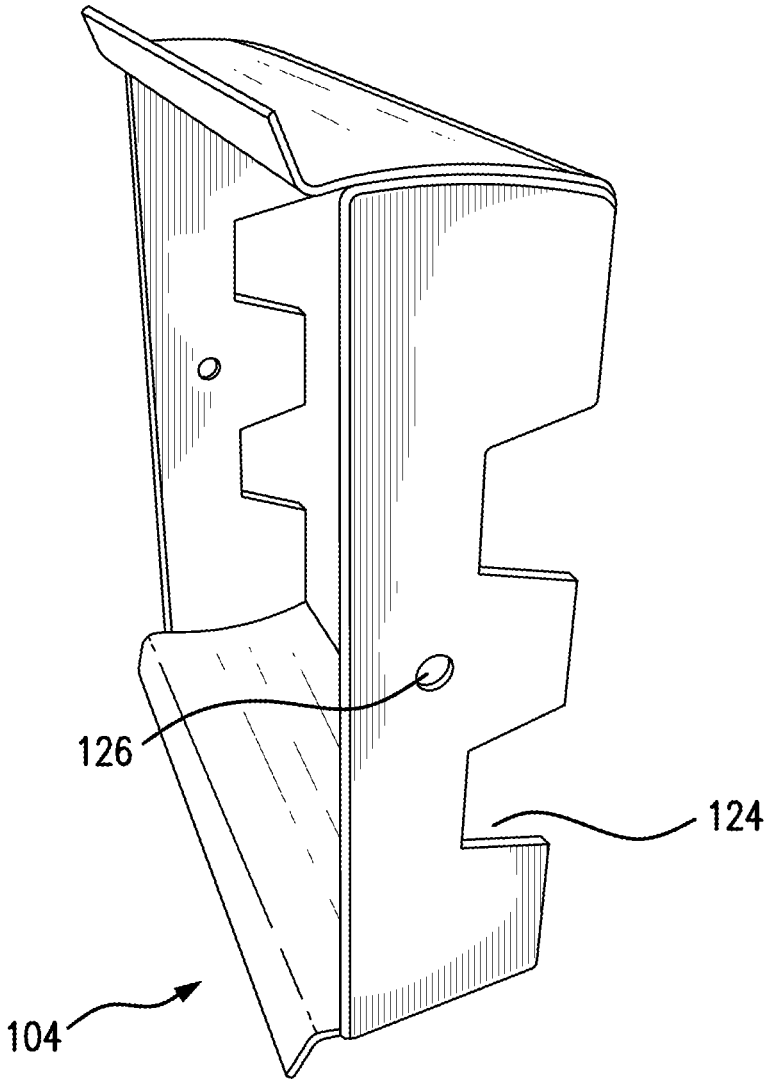
FIG. 4 is a perspective view of an exemplary embodiment of a seal plate constructed in accordance with embodiments of the present invention, showing notches in the seal plate.

As shown in FIG. 4, each side of seal plate 104 includes notches 124 and a hole 126 defined between notches 124. When assembled, a pivot pin, described in more detail below, is defined through hole 126. Notches 124 permit access to an interior of nozzle tip 102 allowing access to link pin holes 137 during assembly.

Figure 6:
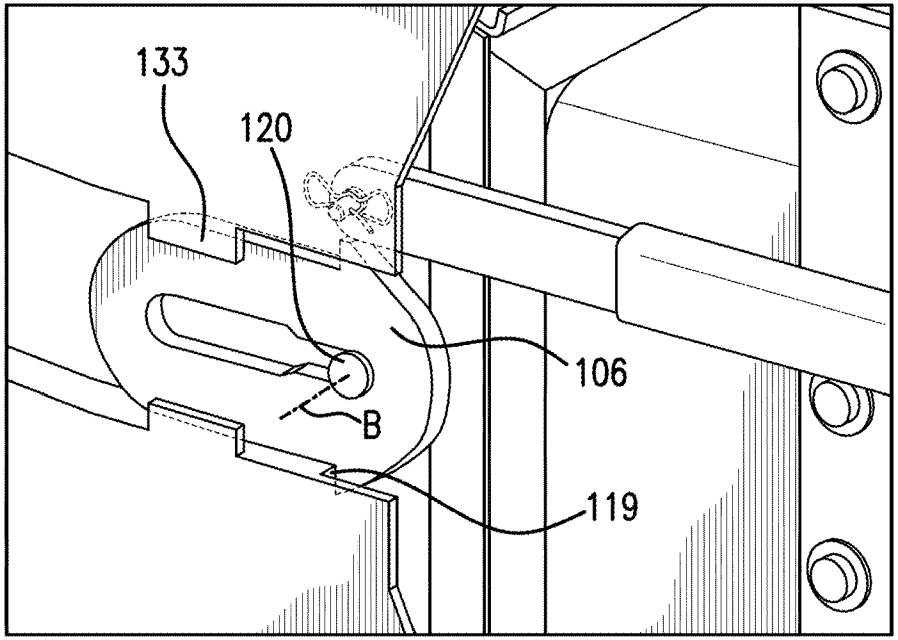
FIG. 6 is a perspective view of a portion of the solid fuel nozzle assembly of FIG. 1, showing the locking plate secured on the nozzle tip, with the nozzle tip shown transparent for clarity.
Figure 5:
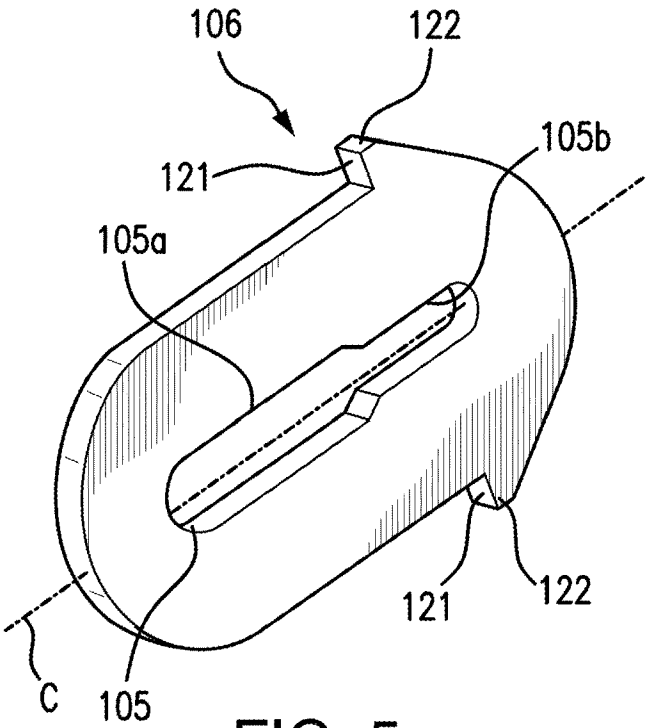
FIG. 5 is a perspective view of an exemplary embodiment of a locking plate constructed in accordance with embodiments of the present invention, showing the elongated plate opening and the opposing projections of the locking plate.

With reference now to FIGS. 5 and 6, locking plate 106 defines a plate axis C. Locking plate 106 includes an elongated plate opening 105 extending along plate axis C. A first portion 105*a* of the elongated plate opening 105 is wider than a second portion 105*b* of elongated plate opening 105. Locking plate 106 includes a pair of opposing projections 122 extending from locking plate 106 at an angle with respect to plate axis C away from elongated plate opening 105. While locking plate 106 is shown and described herein as having an elongated plate opening 105 with two different widths, it is contemplated that elongated plate opening 105 can have equal widths along its length. Each opposing projection 122 includes an edge 121 that abuts a respective surface 119 of tip body 103 that faces inlet side 118 of tip body 103 to secure locking plate 106 in the horizontal direction, e.g. in a direction parallel to plate axis C. When assembled, locking plate 106 is nested under tabs 133 in retaining aperture 125. Opposing projections 122 ensure locking plate 106 is secured prior to welding in place. Locking plate 106 utilizes redundant mechanical engagement feature, e.g. elongated plate opening 105, for reliable operation. A portion of elongated plate opening 105 is aligned with slot 112 of tip body 103 so that pivot pin 120 passes through locking plate 106 and tip body 103.

Figure 7:
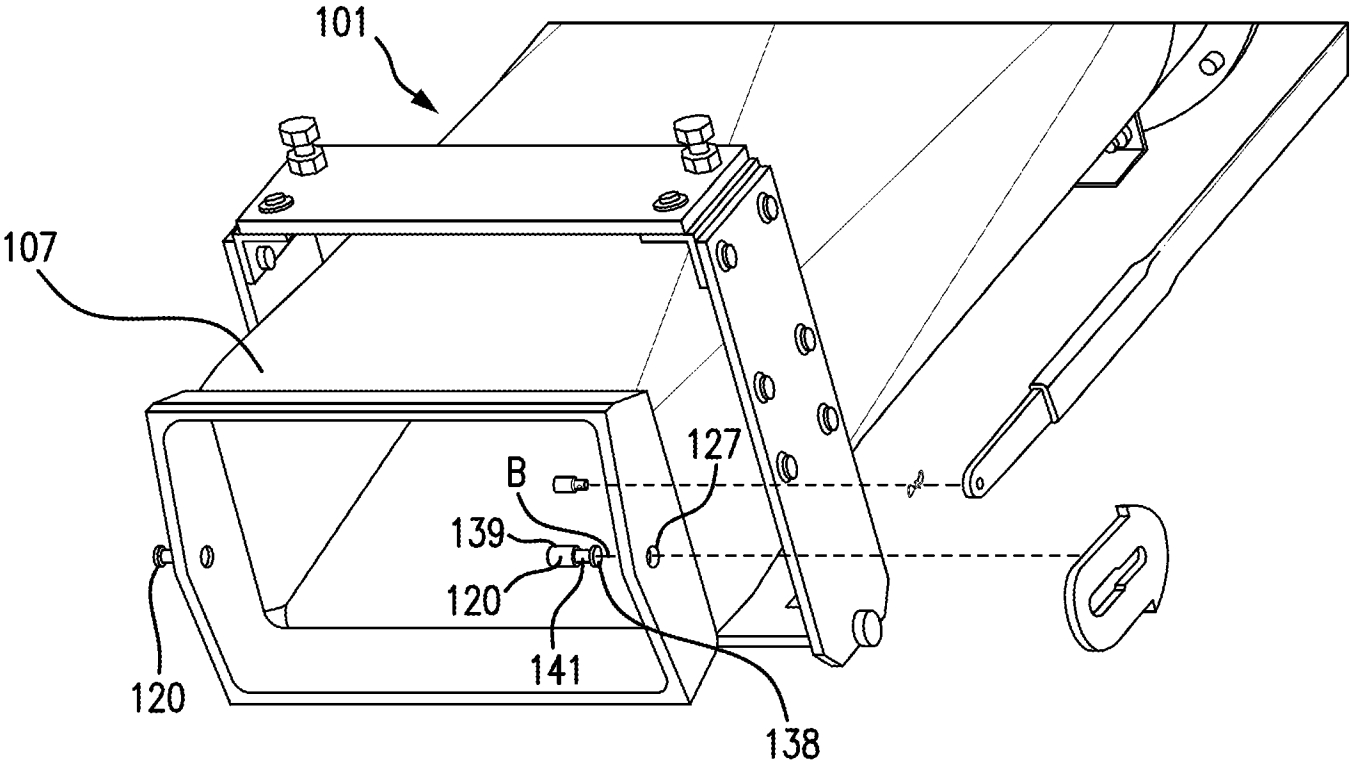
FIG. 7 is an exploded perspective view of a portion of the solid fuel nozzle assembly of FIG. 1, showing the nozzle tip pivot pins and horizontal connecting link pin.
Figure 8:
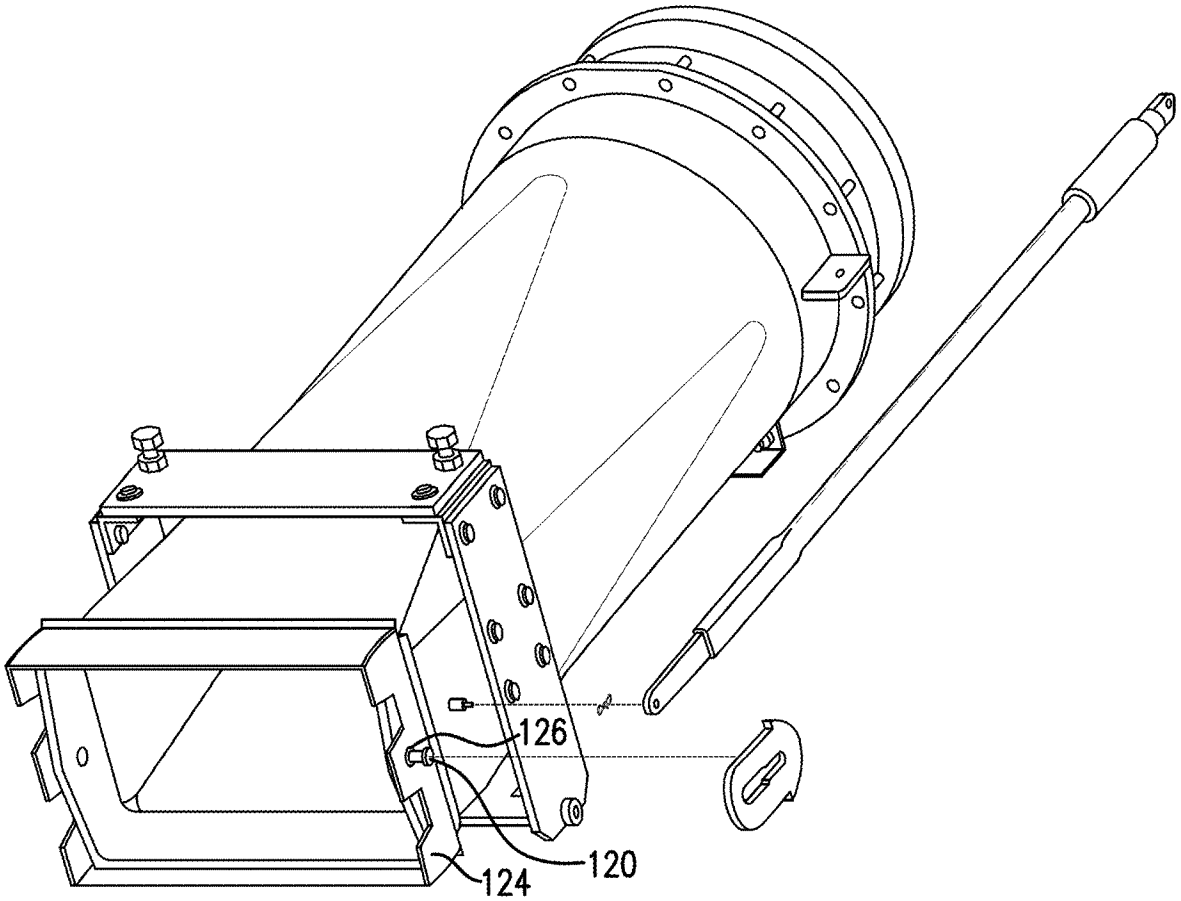
FIG. 8 is an exploded perspective view of a portion of the solid fuel nozzle assembly of FIG. 1, showing the seal plate on the nozzle body.
Figure 9:
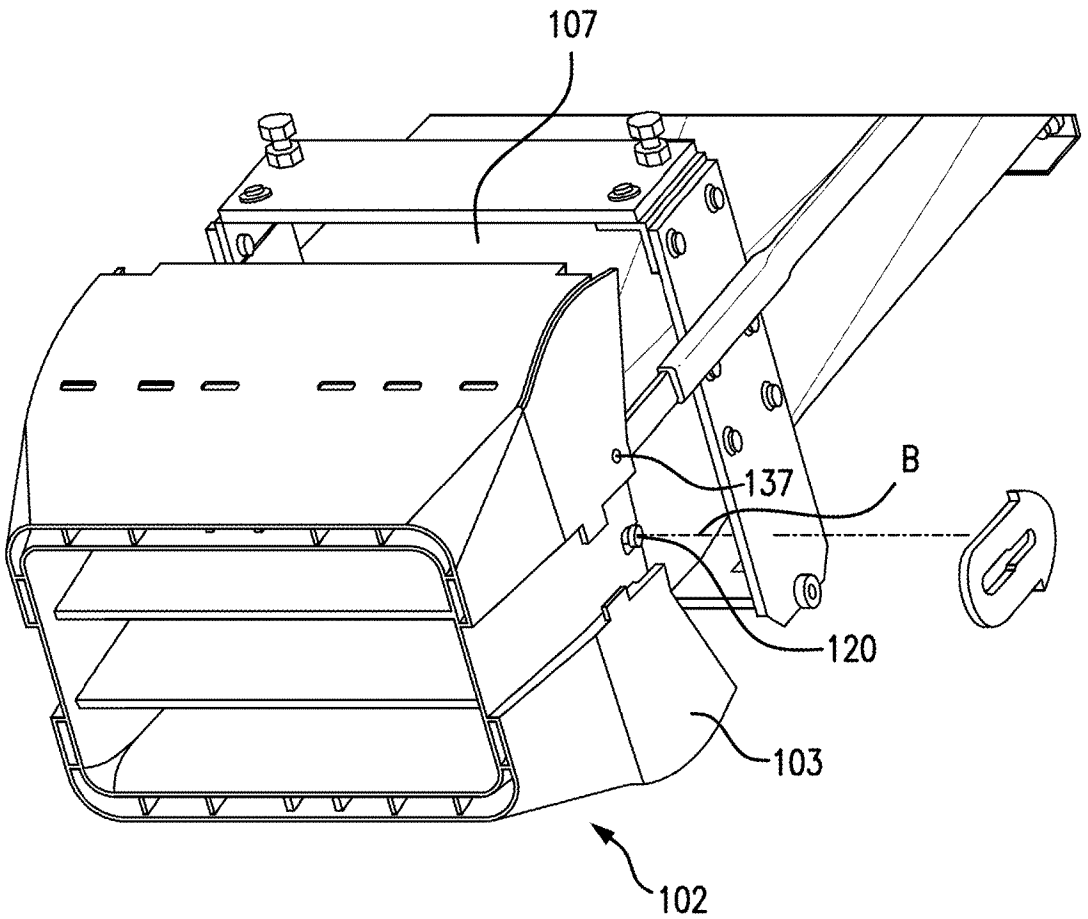
FIG. 9 is an exploded perspective view of a portion of the solid fuel nozzle assembly of FIG. 1, showing nozzle tip assembled onto the nozzle body.

With reference now to FIGS. 7-9, pivot pins 120 engage with respective holes 127 in nozzle 101 and respective holes 126 in seal plate 124. Pivot pins 120 are welded to nozzle 101. Pivot pins 120 have chamfered ends so that when welded, each pivot pin 120 has maximum engagement with its respective hole 127. It is contemplated that when welded, the weld can be ground down, if needed, so that the weld is flush with the interior surface of nozzle 101. During assembly, each slot 112 receives a respective pivot pin 120 and guides its respective pivot pin 120 into a respective recess 114 of slot 112. Recesses 114 of slots 112 are configured to at least partially retain it respective pivot pin 120. Recesses 114 provide a "self-locating" feature for easy installation of nozzle tip 102 onto nozzle 101. In an assembled position, pivot pins 120 are welded to nozzle body 107 and extend through their respective recess 114 and through respective elongated plate openings 105 of locking plates 106 to facilitate rotation of tip body 103 and locking plate 106 about a pivot pin axis B defined by pivot pins 120. Pivot pin 120 includes a head portion 138 and a base portion 139 opposite head portion 138, with a middle portion 141 therebetween. Middle portion 141 has a reduced diameter as compared to head portion 138 and base portion 139. Head portion 138 and middle portion 141 provide redundant mechanical engagement features. While shown and described with head portion 138 and middle portion 141, it is contemplated that pivot pin 120 can be a pin having a consistent single diameter and/or a pin with just a head portion, e.g. without middle portion 141.

Figure 11:
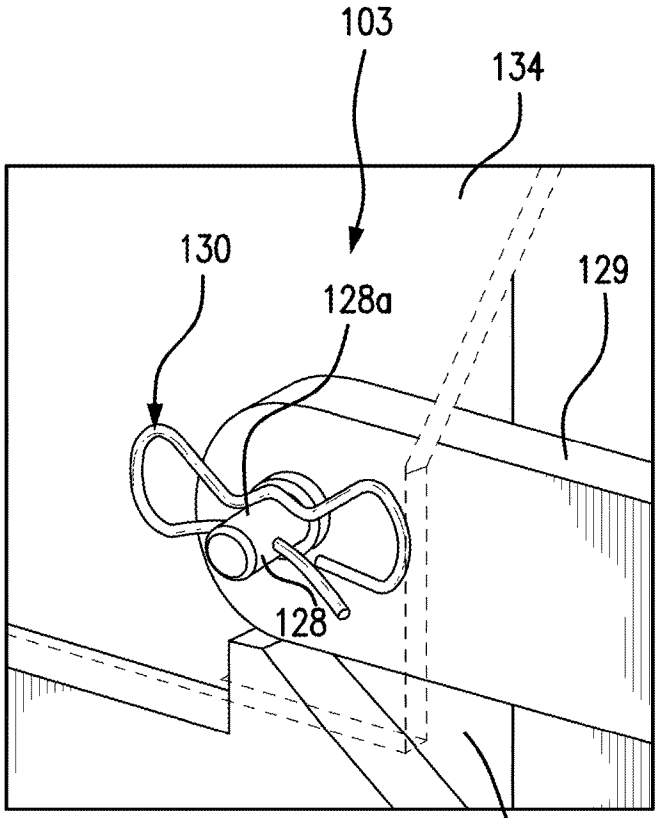
FIG. 11 is a perspective view of a portion of the solid fuel nozzle assembly of FIG. 1, showing the link pin secured with the bow-tie cotter pin.
Figure 10:
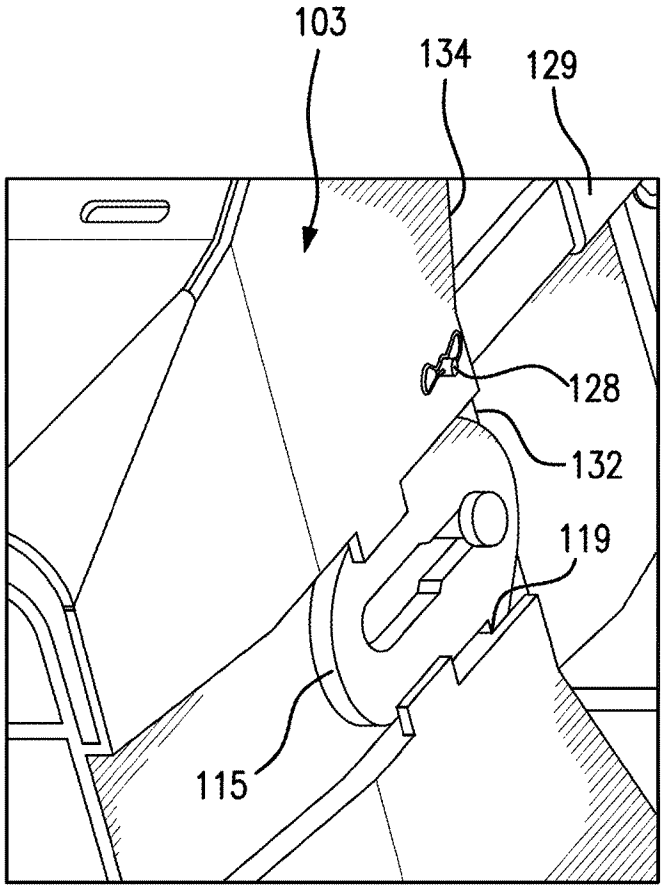
FIG. 10 is a perspective view of a portion of the solid fuel nozzle assembly of FIG. 1, showing a weld location between the locking plate and the nozzle tip.

With reference now to FIGS. 10 and 11, each locking plate 106 is welded to tip body 103 at a respective weld joint 115. Nozzle assembly 100 includes a link pin 128 for securing a reach rod 129 between inner and outer shells 132 and 134, respectively, of tip body 103. As shown in FIG. 5A, link pin 128 has two different diameters, e.g. link pin portion 128*a* has a smaller diameter than link pin portion 128*b*, which secures it in place once a cotter pin 130 is installed. It is contemplated that link pin 128 can be installed and/or removed with nozzle tip 102 in place due to notches 124 in seal plate 104 allowing access to link pin holes 137.

Figure 12:
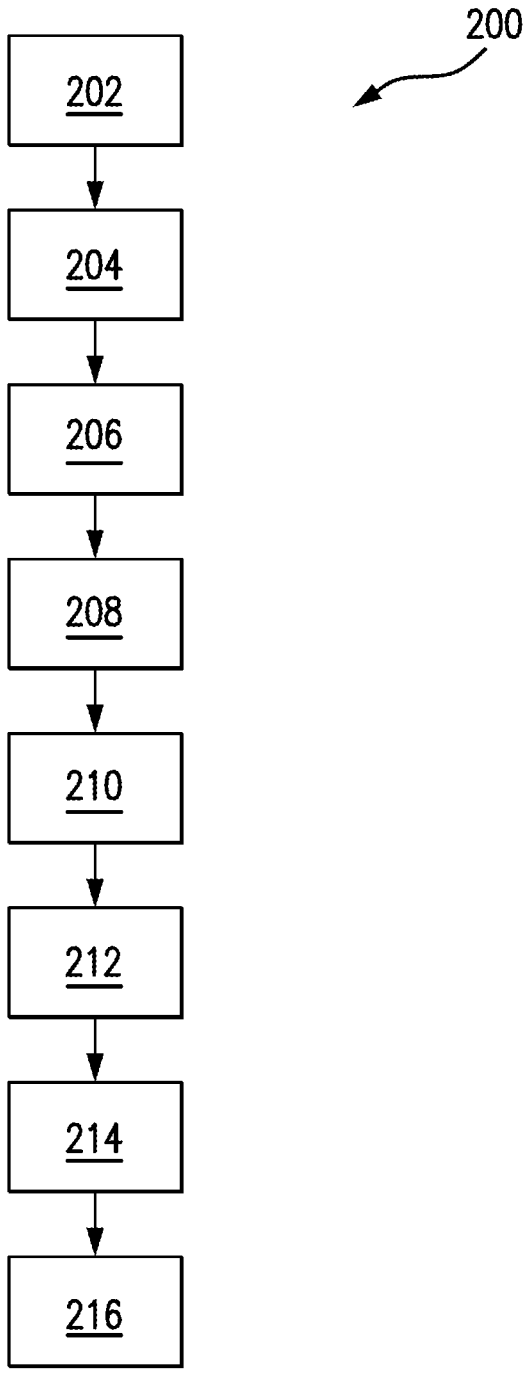
FIG. 12 is a schematic diagram showing a method for retrofitting a solid fuel nozzle in accordance with embodiments of the present invention.

As shown in FIG. 12, a method 200 of retrofitting a solid fuel nozzle with a new nozzle tip, e.g. nozzle tip 102, includes removing a seal plate, e.g. an existing seal plate, from a nozzle body, e.g. nozzle body 107, as indicated by box 202. Before removing the existing seal plate, the method includes positioning the existing tip to −25°, with respect to longitudinal axis A, prior to equipment lockout and removing the existing tip. After removal of the existing tip and the existing seal plate, the existing seal plate is modified or replaced in order to work with embodiments of the nozzle assembly, e.g. nozzle assembly 100, described above. Method 200 includes cutting notches, e.g. notches 124, into the existing seal plate, and re-positioning the modified seal plate, e.g. seal plate 104, over the nozzle body, as indicated by box 204. Method 200 includes inserting pivot pins, e.g. pivot pin 120, from an interior of the nozzle body through holes, e.g. holes 127, in the nozzle body and holes, e.g. holes 126, in the seal plate and welding the pivot pins to the nozzle body, as indicated by box 206. It is contemplated that pivot pins can be seal welded to the nozzle body.

With continued reference to FIG. 12, method 200 includes positioning a tip body, e.g. tip body 103, over the nozzle body and sliding the tip body over the pivot pins, as indicated by box 208. The pivot pins engage with respective slots of the tip body, slide along their respective slots, and engage with respective recesses, e.g. recess 114, of each slot. Method 200 includes engaging a first portion, e.g. first portion 105*a*, of an elongated plate opening, e.g. elongated plate opening 105, of a locking plate, e.g. locking plate 106, with a portion of the pivot pin that protrudes from an exterior side of the tip body, as indicated by box 210. Method 200 includes pulling and/or pushing the locking plate toward an outlet, e.g. outlet 110, of the tip body along a longitudinal axis, e.g. longitudinal axis A, to engage the pivot pin with a second portion, e.g. second portion 105*b*, of the elongated plate opening of the locking plate, as indicated by box 212. This can be repeated for each side of the nozzle body and can include two locking plates, one for each side. This nests each locking plate under its respective tabs, e.g. tabs 133, defined on each side of the tip body to secure the tip body, the locking plate and the pivot pin together. It is contemplated that method 200 can include welding each locking plate to the tip body, e.g. to an exterior surface of the inner shell of the tip body.

As shown in FIG. 12, method 200 includes positioning a reach rod, e.g. reach rod 129 within the tip body to align a hole in the reach rod the link pin holes, e.g. link pin holes 137, in the tip body, as indicated by box 214. Method 200 includes inserting a link pin, e.g. link pin 128, from an interior of the tip body through the link pin hole in the tip body and the hole in the reach rod, as indicated by box 216. For installation of the link pin, the new tip, e.g. tip body 103, can be full tilted downward (−25°), with respect to the longitudinal axis. Using rigging and/or a related tool, the method can include rotating tip upwards to 25° with respect to the longitudinal axis while holding the link rod in position until holes line up. Method 200 includes securing the link pin within the link pin hole of the tip body and the hole of the reach rod with a cotter pin, e.g. a bow-tie cotter pin 130.

The methods and systems of the present invention, as described above and shown in the drawings, provide for coal tips with superior properties including reduced installation time and increased ease of installation. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A solid fuel nozzle tip for issuing a flow of mixed solid fuel and air to a boiler comprising:

a tip body having an inlet and an outlet defining a longitudinal axis therebetween, wherein the tip body includes a slot on an inlet side of the tip body extending in a direction parallel to the longitudinal axis, wherein the slot includes an opening facing the inlet side of the tip body and wherein the slot includes a recess formed at an angle with respect to the longitudinal axis to at least partially retain a pivot pin, wherein the tip body includes an inner shell and an outer shell, wherein the outer shell is radially outward from the inner shell with respect to the longitudinal axis, wherein the slot is defined on the inner shell, wherein the outer shell includes a tab radially outward from the slot with respect to the longitudinal axis, and wherein the tab extends from an end of the outer shell over a portion of the inner shell to form a retaining aperture therebetween.

2. A solid fuel nozzle assembly for issuing a flow of mixed solid fuel and air to a boiler comprising:

a solid fuel nozzle tip including a tip body having an inlet and an outlet defining a longitudinal axis therebetween, wherein the tip body includes a slot on an inlet side of the tip body extending in a direction parallel to the longitudinal axis, wherein the slot includes an opening facing the inlet side of the tip body and wherein the slot includes a recess at an angle with respect to the longitudinal axis to at least partially retain a pivot pin, wherein the tip body includes an inner shell and an outer shell, wherein the outer shell is radially outward from the inner shell with respect to the longitudinal axis, wherein the slot is defined on the inner shell, and wherein the outer shell includes a tab radially outward from the slot with respect to the longitudinal axis, wherein the tab extends from an end of the outer shell over a portion of the inner shell to form a retaining aperture therebetween, wherein the locking plate is nested within the retaining aperture and is retained by the tab; and a locking plate operatively connected to the tip body to assist in retaining a pivot pin within the slot of the tip body.

3. The solid fuel nozzle assembly as recited in claim 2, further comprising a nozzle body operatively connected to the inlet of the tip body for introducing a flow of mixed solid fuel and air to the tip body.

4. The solid fuel nozzle assembly as recited in claim 3, further comprising a pivot pin defining a pivot axis, wherein the pivot pin is welded to the nozzle body and inserted through the recess of the slot of the tip body and an elongated plate opening of the locking plate to facilitate rotation of the tip body and the locking plate about the pivot pin.

5. The solid fuel nozzle assembly as recited in claim 3, further comprising a seal plate operatively connected to the nozzle body, between the nozzle body and the tip body.

6. The solid fuel nozzle assembly as recited in claim 2, wherein the locking plate defines a plate axis and includes an elongated plate opening extending along the plate axis, wherein the locking plate includes a pair of opposing projections extending at an angle with respect to the plate axis away from the elongated plate opening.

7. The solid fuel nozzle assembly as recited in claim 6, wherein each opposing projection includes an edge that abuts a surface of the tip body that faces the inlet side of the tip body.

8. The solid fuel nozzle assembly as recited in claim 6, wherein at least a portion of the elongated plate opening is aligned with the slot of the tip body so that a pivot pin is able to pass through the locking plate and the tip body.

9. The solid fuel nozzle assembly as recited in claim 6, wherein a first portion of the elongated plate opening is wider than a second portion of the elongated plate opening.

10. A solid fuel nozzle assembly for issuing a flow of mixed solid fuel and air to a boiler comprising:

a solid fuel nozzle tip including a tip body having an inlet and an outlet defining a longitudinal axis therebetween, wherein the tip body includes a slot on an inlet side of the tip body extending in a direction parallel to the longitudinal axis, wherein the slot includes an opening facing the inlet side of the tip body and wherein the slot includes a recess at an angle with respect to the longitudinal axis to at least partially retain a pivot pin; and a locking plate operatively connected to the tip body to assist in retaining a pivot pin within the slot of the tip body, wherein the locking plate defines a plate axis and includes an elongated plate opening extending along the plate axis, wherein the locking plate includes a pair of opposing projections extending at an angle with respect to the plate axis away from the elongated plate opening.

11. The solid fuel nozzle assembly as recited in claim 10, wherein each opposing projection includes an edge that abuts a surface of the tip body that faces the inlet side of the tip body.

12. The solid fuel nozzle assembly as recited in claim 10, wherein at least a portion of the elongated plate opening is aligned with the slot of the tip body so that a pivot pin is able to pass through the locking plate and the tip body.

13. The solid fuel nozzle assembly as recited in claim 10, wherein a first portion of the elongated plate opening is wider than a second portion of the elongated plate opening.

14. The solid fuel nozzle assembly as recited in claim 10, further comprising a nozzle body operatively connected to the inlet of the tip body for introducing a flow of mixed solid fuel and air to the tip body.

15. The solid fuel nozzle assembly as recited in claim 14, further comprising a pivot pin defining a pivot axis, wherein the pivot pin is welded to the nozzle body and inserted through the recess of the slot of the tip body and the elongated plate opening of the locking plate to facilitate rotation of the tip body and the locking plate about the pivot pin.

16. The solid fuel nozzle assembly as recited in claim 14, further comprising a seal plate operatively connected to the nozzle body, between the nozzle body and the tip body.

17. A method of retrofitting a solid fuel nozzle, the method comprising:

positioning a solid fuel nozzle tip for issuing a flow of mixed solid fuel and air to a boiler over a nozzle body, wherein the nozzle body includes a pivot pin extending therefrom, wherein a tip body of the solid fuel nozzle tip includes:

an inlet and an outlet defining a longitudinal axis therebetween;

a slot on an inlet side of the tip body extending in a direction parallel to the longitudinal axis, wherein the slot includes an opening facing the inlet side of the tip body and wherein the slot includes a recess formed at an angle with respect to the longitudinal axis to at least partially retain a pivot pin; and an inner shell and an outer shell, wherein the outer shell is radially outward from the inner shell with respect to the longitudinal axis, wherein the slot is defined on the inner shell, wherein the outer shell includes a tab radially outward from the slot with respect to the longitudinal axis, and wherein the tab extends from an end of the outer shell over a portion of the inner shell to form a retaining aperture therebetween; and sliding the tip body over the pivot pin, wherein the pivot pin engages with the slot of the tip body, slides along the slot, and engages with the recess of the slot.

18. The method as recited in claim 17, further comprising removing a seal plate from the nozzle body, cutting notches into the seal plate, and re-positioning the seal plate over the nozzle body.

19. The method as recited in claim 17, further comprising inserting the pivot pin from an interior of the nozzle body through an aperture in the nozzle body and welding the pivot pin to the nozzle body.

20. The method as recited in claim 17, further comprising positioning a reach rod within the tip body to align a hole in the reach rod with a link pin hole in the tip body.

21. The method as recited in claim 20, further comprising inserting a link pin from an interior of the tip body through the link pin hole in the tip body and the hole in the reach rod.

22. The method as recited in claim 21, further comprising securing the link pin within the link pin hole of the tip body and the hole of the reach rod with a cotter pin.

23. The method as recited in claim 17, further comprising engaging a first portion of an elongated plate opening of a locking plate with a portion of the pivot pin that protrudes from an exterior side of the tip body.

24. The method as recited in claim 23, further comprising pulling the locking plate toward the outlet of the tip body along the longitudinal axis to engage the pivot pin with a second portion of the elongated plate opening of the locking plate and to nest the locking plate under the tab defined in the exterior side of the tip body to secure the tip body, the locking plate and the pivot pin together.

25. A method of retrofitting a solid fuel nozzle assembly for issuing a flow of mixed solid fuel and air to a boiler, the method comprising:

positioning a solid fuel nozzle tip including a tip body over a nozzle body, wherein the nozzle body includes a pivot pin extending therefrom, wherein the tip body includes:

an inlet and an outlet defining a longitudinal axis therebetween; and a slot on an inlet side of the tip body extending in a direction parallel to the longitudinal axis, wherein the slot includes an opening facing the inlet side of the tip body and wherein the slot includes a recess formed at an angle with respect to the longitudinal axis to at least partially retain a pivot pin;

sliding the tip body over the pivot pin, wherein the pivot pin engages with the slot of the tip body, slides along the slot, and engages with the recess of the slot; and engaging a locking plate with the pivot pin to operatively connect the locking plate to the tip body to assist in retaining the pivot pin within the slot of the tip body, wherein the locking plate defines a plate axis and includes an elongated plate opening extending along the plate axis, wherein the locking plate includes a pair of opposing projections extending at an angle with respect to the plate axis away from the elongated plate opening.

26. The method as recited in claim 25, further comprising removing a seal plate from the nozzle body, cutting notches into the seal plate, and re-positioning the seal plate over the nozzle body.

27. The method as recited in claim 25, further comprising inserting the pivot pin from an interior of the nozzle body through an aperture in the nozzle body and welding the pivot pin to the nozzle body.

28. The method as recited in claim 25, further comprising positioning a reach rod within the tip body to align a hole in the reach rod with a link pin hole in the tip body.

29. The method as recited in claim 28, further comprising inserting a link pin from an interior of the tip body through the link pin hole in the tip body and the hole in the reach rod.

30. The method as recited in claim 29, further comprising securing the link pin within the link pin hole of the tip body and the hole of the reach rod with a cotter pin.

31. The method as recited in claim 25, wherein engaging the locking plate with the pivot pin includes engaging a first portion of the elongated plate opening of the locking plate with a portion of the pivot pin that protrudes from an exterior side of the tip body.

32. The method as recited in claim 31, further comprising pulling the locking plate toward the outlet of the tip body along the longitudinal axis to engage the pivot pin with a second portion of the elongated plate opening of the locking plate and to nest the locking plate under a tab defined in the exterior side of the tip body to secure the tip body, the locking plate and the pivot pin together.

* * * * *